United States Patent [19]

Mall et al.

[11] Patent Number: 4,768,773

[45] Date of Patent: Sep. 6, 1988

[54] APPARATUS AND METHOD FOR THE STACKING AND STORING OF WORKPIECES

[75] Inventors: Günter Mall; Karl-Ludwig Manuel, both of Kaiserslautern, Fed. Rep. of Germany

[73] Assignee: Pfaff Industriemaschinen GmbH, Fed. Rep. of Germany

[21] Appl. No.: 870,159

[22] Filed: Jun. 2, 1986

[30] Foreign Application Priority Data

Jun. 3, 1985 [DE] Fed. Rep. of Germany ..... 3519813

[51] Int. Cl.[4] ..... B65H 39/10

[52] U.S. Cl. ..... 271/299; 271/176; 271/177; 271/184; 271/189; 271/202; 271/213; 112/121.29; 414/46; 414/47; 414/102

[58] Field of Search ..... 271/177, 180, 299, 306, 271/176, 184, 207, 213, 3.1, 3, 7, 189, 198, 199, 202; 414/43, 46, 47, 97, 101, 102; 112/121.29

[56] References Cited

U.S. PATENT DOCUMENTS

| | | | |
|---|---|---|---|
| 3,131,819 | 5/1964 | Ducayet, Jr. | 414/47 |
| 3,367,651 | 2/1968 | Eller et al. | 112/121.29 X |
| 3,412,875 | 11/1968 | Wejr | 414/46 X |
| 3,507,489 | 4/1970 | Wilshin et al. | 271/202 X |
| 3,618,546 | 11/1971 | Preston | 112/121.29 |
| 3,767,065 | 10/1973 | Hall et al. | 414/47 X |
| 3,848,866 | 11/1974 | Fuller, Jr. et al. | 271/83 X |
| 4,465,270 | 8/1984 | Amato | 271/198 |

*Primary Examiner*—Joseph J. Rolla
*Assistant Examiner*—David H. Bollinger
*Attorney, Agent, or Firm*—McGlew and Tuttle

[57] ABSTRACT

A system for the stacking and storing of workpieces particularly from a sewing machine comprises a movable carrier with two receiving compartments for the workpieces to be stacked, two storage channels spaced from each other by the width of a receiving compartment, and two push units. The carrier is so controlled by a pneumatic cylinder that one of the receiving compartments stands in stack forming position below a work transfer device and the other is aligned with one of the storage channels.

2 Claims, 2 Drawing Sheets

APPARATUS AND METHOD FOR THE STACKING AND STORING OF WORKPIECES

FIELD AND BACKGROUND OF THE INVENTION

This invention relates in general to sewing machines and in particular to a new and useful apparatus and method for stacking and storing of workpieces which are sewn on the sewing machine., A system for stacking and storing workpieces can be seen from U.S. Pat. No. 3,848,866. This system comprises, below a workpiece feeding device, a stationary support plate on which the delivered workpieces are piled up in a stack forming point to a storage place. Since after the displacement of a stack the slide must be moved back to its starting position again, and in doing so it is moved over the stack forming point, the first workpiece of the next stack cannot be deposited until after the slide has reached its starting position again. Due to this sequence, it might, if the workpieces are delivered in quick sucession, be necessary to decelerate the workpiece throughout during or after the displacement of a stack or respectively to briefly stop a preceding treatment machine.

SUMMARY OF THE INVENTION

The invention provides a system for the stacking and storing of workpieces wherein a finished stack can be moved into a storage area without delay or interruption of the workpiece throughout.

By the measure of providing at the carrier for the workpieces to be stacked at least two receiving places and to arrange it movable rhythmically by the width of one receiving place in such a way that always one of the receiving places is in the stacking forming position and another in the region of the displacing device, it is possible simultaneously during the removing of one receiving place occupied by a stack from the stack forming region to introduce an empty receiving place into the stack forming region. As this process can be carried out very much faster than the reciprocating movement of a slide moving the stack, it is not necessary, even at a high workpiece throughput through the preceding treatment machine and a resulting rapid succession of the workpieces, either to interrupt the work stream, nor must a special gap be provided betwen the last workpiece of a stack and the following first workpiece of the next stack.

During the next stack forming process there is then sufficient time to push the stack which has been transferred by the displacement of the carrier into the region of the shifting device, away from the carrier and into a storage channel. If the carrier is designed as a rhythmically revolving conveyor belt, there can be asigned to the carrier, in dependence on its length, a plurality of storage channels which make it possible that differing workpieces are sorted according to concordant features.

The receiving places of the carrier are advantageously formed as laterally open receiving compartments, in which the stacks are secured against slipping during the movement of the carrier. Owing to this, the carrier speed can be increased and the acceleration and deceleration phases shortened, so that the total movement of the carrier can proceed very much faster. In this manner the system according to the invention is suitable also for the stacking of narrow workpieces which therefore are treated in a relatively short time, as well as for workpieces succeeding each other at short intervals.

A system of especially simple design is, where the reversible drive and the two push units of the shifting device can be formed, e.g. by pressure medium cylinders.

Accordingly it is an object of the invention to provide a system or apparatus for delivering workpieces particularly from a sewing machine as they are sewn into a storage.

A further object of the invention is to provide a method for handling workpieces as they are sewn in order to effect their proper storage which comprises feeding the workpieces one after the other away from the sewing machine, depositing the workpieces into one of a plurality of stacking receptacles after the receptacles are positioned selectively at the depositing area, pushing the stacks after they are formed out of the receptacles and into a storage channel after the storing receptacle is first shifted into alignment with the storing channel and another receptacle is positioned in the alignment with the despositing area.

A further object of the invention is to provide an apparatus for effecting storage of workpieces first into a stack in a receptacle after it is aligned at a depositing area, including means for shifting the storage receptacle into alignment with a selective storage channel while simultaneously shifting another receptacle into alignment with a stacking position at the depositing area.

A further object of the invention is to provdie a system and apparatus for storing workpieces which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
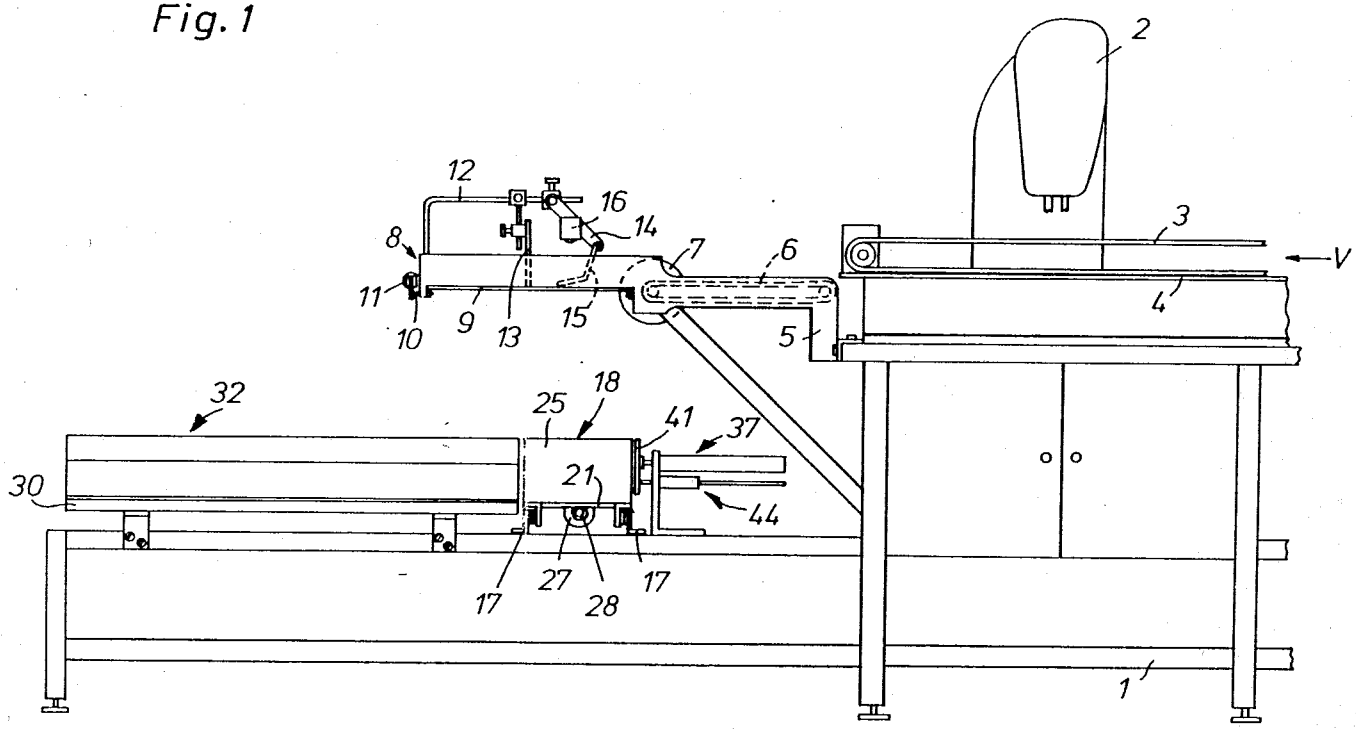
FIG. 1 is a side elevational view of a sewing unit and having a system for the stacking and storing of workpieces constructed in accordance with the invention.

Referring to the drawings in particular, the invention embodied therein comprises a device for delivering workpieces as they are sewed by a sewing machine 2 into one of a plurality of receiving receptacles or receiving places 22 and 23 which are positioned on a carrier 18 which may be shifted by a control device or fluid cylinder 29. In accordance with the method of the invention, one of the receptacles 22 is aligned below a depositing area or stacking area of receptacles which are fed away by conveyors 6 and 3 and dropped down into the receiving place 22 or 23 depending on which is aligned therebelow. When a stack S is formed the carrier 18 is shifted to present an empty receiving space in the stacking area and the finished stack is positioned in alignment with either a storage channel 31 or a storage channel 32. Shifting means 44 are then provided to engage the stack from the open ended receiving places and push it transversely into a receiving channel or storage channel.

A stand 1 has a sewing machine 2 arranged on it. To carry out the feed movement of the workpieces W during sewing, a transport belt 3 driven jointly with the sewing machine is provided, and associated with it is a stationary flat support plate 4 for the workpiece W.

On a frame 5 resting on stand 1 a wide conveyor belt 6 is arranged, which is drivable by a motor 7. Frame 5 has arranged on it further a work transfer device 8, which is designed similar to the corresponding part of a stacking device disclosed in German OS No. 1 660 982. Accordingly, the transfer device 8 comprises two flaps 9 which are adapted to pivot about a horizontal axis extending parallel to the work feed direction V. The flaps 9 are connected via a linkage 10 with a pneumatic cvlinder 11. A stop plate 13 is adjustably clamped on a rod 12 fastened to frame 5. Also disposed on rod 12, at an adjustable arm 14, is a thin flexible reflection plate 15, which cooperates with a reflected light barrier 16 attached to the arm 14.

Below the transfer device 8, a carrier 18 in the form of a cariage runs on horizontal rails 17 extending crosswise to the feed direction V. The carrier 18 comprises two angle strips 20, provided with rollers 19 and carrying a horizontal plate 21. On plate 21, two receiving places 22, 23 in the form of compartments are provided for workpieces W to be stacked. Each of these compartments 22 and 23 comprises a receiving plate 24 inclined under a flat angle, a vertical support plate 25, as well as a support plate 26 extending obliquely under a steep angle. At a projection 27 of plate 21 the piston rod 28 of a piston (not shown) movable in a stack controller or a pneumatic cylinder 29 is arranged.

Figures 2, 3:
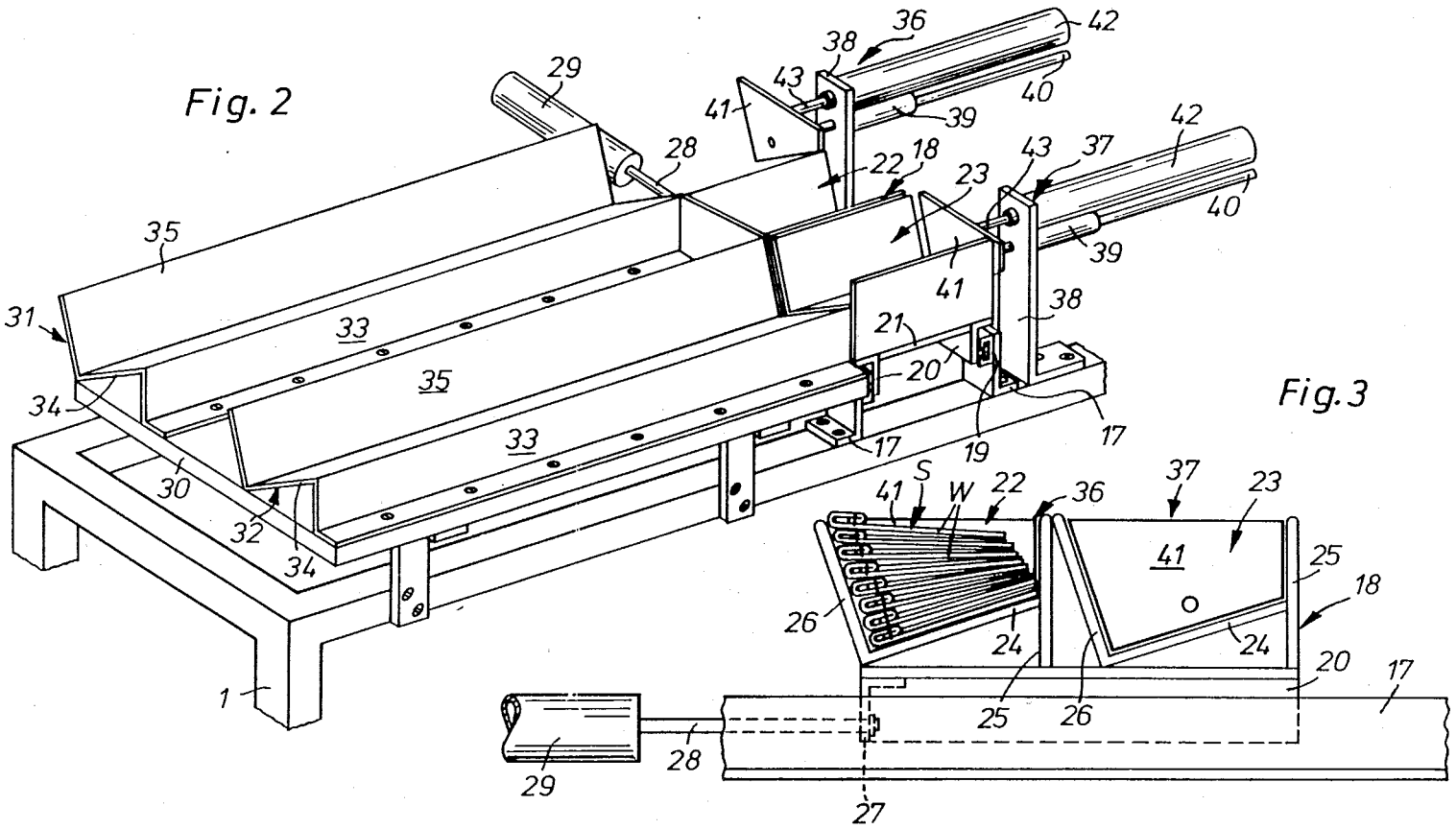
FIG. 2 is a perspective view of the system above.
FIG. 3 is a side elevational detail view of the carrier of the system.

On a carrier plate 30 secured on stand 1 are arranged two storage channels 31, 32, each consisting of an angle plate 33 secured on the carrier plate 30, a receiving plate 34 extending under a flat angle, and a limiting plate 35 extending more steeply. the two storage channels 31, 32 run parallel to the feed direction V, and have a mutual distance which corresponds to the width of each single compartment 22, 23 of the carrier 18. The storage channels 31, 32 are further arranged so that the storage channel 32 is, when the piston rod 28 is extended as shown in FIG. 2, aligned with the compartment 23, and the storage channel 31 is aligned with compartment 22 when the piston rod 28 is retracted., To each storage channel 31, 32 a push unit 36, 37 is assigned. The two push units 35, 37 consists of an angle plate 38 disposed on stand 1 before carrier 18 in feed direction V, a guide sleeve 39 for a guide rod 40, a vertical push plate 41 in a form corresponding to the angular position of the plates 24,25, 26, as well as a pneumatic cylinder 42, whose piston rod 43 is connected with the push plate 41. Together the two push units 36,37 form a shifting device 44.

The system operates as follows:

The workpiece W, moved along on the support plate 4 by the transport belt 3 during the sewing, are transferred onto the conveyor belt 6 one after the other. Belt 6 is driven very much faster than belt 3, whereby a greater distance is created between a workpiece lying on belt 6 and the next workpiece, still seized by belt 3.

The conveyor belt 6 moves the workpiece at the respective speed onto the flaps 9 up to the stop plate 13. With that, the workpiece lifts the reflection plate 15 so high that the light ray emitted by the emitter of the reflected light barrier 16 is reflected to the receiver and generates a signal. This signal is processed in a known control circuit (not explained in greater detail) to the effect that the pneumatic cylinder 11 is pressurized with a minimum of delay while at the same time pivoting the flaps 9 into the open position. As a result, the workpiece previously conveyed onto the flaps 9 falls into the compartment 22 or 23 of the carrier 18, which is in the stack forming position and located under the flaps 9. According to FIG. 2, piston rod 28 is extended, and as a result compartment 22 is in the stack forming position and compartment 23 is located between storage channel 32 and push unit 37.

On the first compartment 22 workpieces are piled up, so that a stack S forms in the compartment 22. The workpieces W illustrated in FIG. 3 are trouser pockets with a seam formed at one side and with an edge folded twice. The obliquely running receiving plate 24 forms a compensation for the uneven thickness of the individual workpieces W, owing to which the uppermost workpiece W of a stack S filling a compartment 22 or 23 extends substantially horizontally.

During the formation of the stack S, the piston rod 43 of push unit 37 is extended and thereby the push plate 41 is moved through compartment 23 into the first region of storage channel 32. Thereafter the piston rod 43 with the push plate 41 is retracted into the starting position. If there was a stack S in compartment 23, it was pushed into the storage channel 32 by the actuation of push unit 37, so that compartment 23 is now empty.

The number of workpieces W forming a stack S can be controlled for example by a sensor controlled counter or with the aid of a scannable mark, for instance a reflecting sticker label, applied on that workpiece W which is to be the topmost workpiece W of a stack S.

As soon as a stack S is completed, the pneumatic cylinder 29 is reversed by a known control circuit (not explained in greater detail) and the carrier 18 is pushed very quickly into its other position, in which now compartment 22 with stack S is between storage channel 31 and push unit 36, while the empty compartment 23 is below the transfer device 8 in the stack forming position.

Thereafter, without interruption, the next stack is formed in compartment 23. Meanwhile the piston rod 43 of push unit 36 is extended, and the push plate 41 is moved through compartment 22 into the first region of storage channel 31. The previously formed stack S is then pushed into the storage channel 31 and compartment 22 is emptied. Thereafter, the piston rod 43 with push plate 41 is retracted into the starting position again.

While a specific embodiment of the invention has been shown and described in detail to illustrate the application of the principles of the invention, it will be understood that the invention may be embodied otherwise without departing from such principles.

What is claimed is:

1. A device for delivering sewing machine workpieces as they are sewn into storage, comprising conveyor means for moving each workpiece as it is formed away from the sewing machine, means along the conveyor means for sensing each article as it is moved and for depositing it, a movable carrier having a plurality of workpiece receiving compartments located so as to position one of said compartments in a position to receive each workpiece as they are deposited and permit their accumulation into a vertical stack, a stack controller connected to said carrier for shifting said carrier to align a selective compartment into a position to receive deposited workpiece stacks extending transversely to said compartments being open on respective opposite ends extending in the same transverse direction as said storage channel, and a shifting device mounted for movement in the transverse direction through an open end of said compartment to push a workpiece stack therein through an opposite end into a storage channel aligned therewith, said conveyor means including a first conveyor extending from the sewing machine outwardly therefrom, a second conveyor arranged adjacent and below the first conveyor in a position to receive workpieces therefrom and being operable at a faster speed than said first conveyor, a receiving plate arranged as an extension of said second conveyor and in position to receive each workpiece, means supporting a light barrier arranged on said receiving place and sensing each workpiece as it is delivered, means for releasing siad plate so that it drops downwardly to deposit a workpiece downwardly on said compartment.

2. A device according to claim 1, wherein said carrier is movable transverse to said second conveyor and has two separate compartments, one of which is always aligned below said plate, said shifting device comprising a fluid pressure operated cylinder and piston combination, said piston having a piston rod with a plate which is movable against the stack of workpieces to shift them out of the compartments.

* * * * *